US007199711B2

(12) United States Patent
Field

(10) Patent No.: US 7,199,711 B2
(45) Date of Patent: Apr. 3, 2007

(54) MOBILE FLOOR CLEANER DATA COMMUNICATION

(75) Inventor: Bruce F. Field, Golden Valley, MN (US)

(73) Assignee: Tennant Company, Minneapolis, MN (US)

( * ) Notice: Subject to any disclaimer, the term of this patent is extended or adjusted under 35 U.S.C. 154(b) by 0 days.

(21) Appl. No.: 11/272,510

(22) Filed: Nov. 10, 2005

(65) Prior Publication Data

US 2006/0103523 A1 May 18, 2006

Related U.S. Application Data

(60) Provisional application No. 60/627,751, filed on Nov. 12, 2004.

(51) Int. Cl.

| | |
|---|---|
| ***G08B 1/08*** | (2006.01) |
| ***G08B 21/00*** | (2006.01) |
| ***A47L 5/00*** | (2006.01) |
| ***A47L 7/00*** | (2006.01) |
| ***G01G 22/00*** | (2006.01) |
| ***G06F 19/00*** | (2006.01) |

(52) U.S. Cl. ..... 340/540; 340/539.1; 340/679; 15/319; 15/320; 15/321; 15/339; 15/340.1; 701/23; 701/24; 700/245

(58) Field of Classification Search ..... 340/539.1, 340/539.24, 540, 679; 15/319–339, 49.1, 15/98, 340.1; 701/23–24; 700/245
See application file for complete search history.

(56) References Cited

U.S. PATENT DOCUMENTS

| | | | | |
|---|---|---|---|---|
| 2,563,151 | A | 8/1951 | Bjorksten | 134/111 |
| 2,731,659 | A | 1/1956 | Coplen | 15/320 |
| 2,993,494 | A | 7/1961 | Svensson | 134/169 |
| 3,037,887 | A | 6/1962 | Brenner et al. | 134/22 |
| 3,078,190 | A | 2/1963 | Blaser et al. | 134/10 |
| 3,162,427 | A | 12/1964 | Knudson et al. | 259/4 |
| 3,212,762 | A | 10/1965 | Carroll et al. | 261/124 |
| 3,231,134 | A | 1/1966 | Webster | 222/1 |
| 3,392,418 | A | 7/1968 | Schowalter | 15/320 |
| 3,436,262 | A | 4/1969 | Crowe et al. | 134/10 |
| 3,453,678 | A | 7/1969 | Gehman et al. | 15/50 |
| 3,460,717 | A | 8/1969 | Thomas | 15/320 |

(Continued)

FOREIGN PATENT DOCUMENTS

DE 44 13 783 A1 3/1995

(Continued)

OTHER PUBLICATIONS

Discover Magazine, Jun. 2002, "Does the Universe Exist if We Don't Observe It?", including cover, Table of Contents, and pp. 26 and 27.

(Continued)

*Primary Examiner*—Daniel Wu
*Assistant Examiner*—Lam Pham
(74) *Attorney, Agent, or Firm*—Westman, Champlin & Kelly, P.A.

(57) ABSTRACT

In a method of communicating data from a mobile floor cleaner to a remote receiver a data communication is initiated from a communicator of the mobile floor cleaner to the remote receiver and data is communicated to the remote receiver with the communicator.

20 Claims, 3 Drawing Sheets

U.S. PATENT DOCUMENTS

| | | | | |
|---|---|---|---|---|
| 3,490,948 | A | 1/1970 | Farison | 134/36 |
| 3,535,162 | A | 10/1970 | Bray et al. | 134/42 |
| 3,549,420 | A | 12/1970 | Cunningham | 134/22 |
| 3,655,096 | A | 4/1972 | Easter | 222/82 |
| 3,676,889 | A | 7/1972 | Edlin | 15/320 |
| 3,761,987 | A | 10/1973 | Nayfa et al. | 15/50 |
| 3,774,262 | A | 11/1973 | Anthony et al. | 15/322 |
| 3,789,449 | A | 2/1974 | MacFarland et al. | 15/4 |
| 3,823,727 | A | 7/1974 | Fry | 137/88 |
| 3,931,662 | A | 1/1976 | Nayfa et al. | 15/320 |
| 3,938,212 | A | 2/1976 | Krier et al. | 15/50 |
| 3,940,826 | A | 3/1976 | Phillips et al. | 15/320 |
| 3,942,218 | A | 3/1976 | Krier et al. | 15/340 |
| 3,974,541 | A | 8/1976 | Silvis et al. | 15/320 |
| 3,979,789 | A | 9/1976 | Peabody et al. | 15/349 |
| 4,000,536 | A | 1/1977 | Nayfa et al. | 15/50 |
| 4,014,808 | A | 3/1977 | Herpers, Jr. et al. | 252/135 |
| 4,032,307 | A | 6/1977 | Sommerfeld | 55/96 |
| 4,037,289 | A | 7/1977 | Dojan | 15/320 |
| D245,994 | S | 10/1977 | Olson | D23/162 |
| 4,061,001 | A | 12/1977 | Von der Eltz et al. | 68/200 |
| 4,096,084 | A | 6/1978 | Thomsen et al. | 252/173 |
| 4,099,285 | A | 7/1978 | Christensen et al. | 15/83 |
| 4,107,075 | A | 8/1978 | Kramer | 252/359 |
| 4,133,773 | A | 1/1979 | Simmons | 252/359 |
| 4,138,756 | A | 2/1979 | Krier et al. | 15/83 |
| RE29,957 | E | 4/1979 | Kasper | 15/83 |
| 4,167,798 | A | 9/1979 | Klugl et al. | 15/320 |
| 4,167,799 | A | 9/1979 | Webb | 15/320 |
| 4,173,056 | A | 11/1979 | Geyer | 15/320 |
| 4,191,590 | A | 3/1980 | Sundheim | 134/21 |
| 4,194,263 | A | 3/1980 | Herpers et al. | 15/353 |
| 4,206,530 | A | 6/1980 | Kroll et al. | 15/340 |
| 4,210,978 | A | 7/1980 | Johnson et al. | 15/320 |
| D257,845 | S | 1/1981 | Peabody et al. | D15/50 |
| 4,258,451 | A | 3/1981 | Sommerfeld | 15/352 |
| 4,262,382 | A | 4/1981 | Brown et al. | 15/49 |
| 4,295,244 | A | 10/1981 | Herpers et al. | 15/320 |
| 4,310,944 | A | 1/1982 | Kroll et al. | 15/346 |
| 4,320,556 | A | 3/1982 | Kimzey et al. | 15/347 |
| 4,334,335 | A | 6/1982 | Brown et al. | 15/319 |
| 4,345,353 | A | 8/1982 | Sommerfeld | 15/349 |
| 4,346,494 | A | 8/1982 | Peabody et al. | 15/179 |
| 4,348,783 | A | 9/1982 | Swanson et al. | 15/320 |
| 4,355,435 | A | 10/1982 | Kimzey et al. | 15/347 |
| 4,365,189 | A | 12/1982 | Hawkins et al. | 318/384 |
| 4,369,544 | A | 1/1983 | Parisi | 15/320 |
| D267,824 | S | 2/1983 | Mannelly | D32/16 |
| 4,373,227 | A | 2/1983 | Kimzey et al. | 15/347 |
| 4,377,017 | A | 3/1983 | Herpers et al. | 15/320 |
| 4,378,855 | A | 4/1983 | Haub et al. | 180/65 |
| 4,393,538 | A | 7/1983 | Olson | 15/320 |
| 4,419,141 | A | 12/1983 | Kunkel | 134/22.12 |
| 4,429,432 | A | 2/1984 | Copeland et al. | 15/320 |
| D273,620 | S | 4/1984 | Kimzey et al. | D32/16 |
| D273,621 | S | 4/1984 | Haub et al. | D32/16 |
| D273,622 | S | 4/1984 | Brown et al. | D32/16 |
| 4,457,036 | A | 7/1984 | Carlson et al. | 15/49 |
| 4,511,486 | A | 4/1985 | Shah | 252/90 |
| 4,557,739 | A | 12/1985 | Fortman et al. | 55/320 |
| 4,570,856 | A | 2/1986 | Groth et al. | 239/310 |
| 4,571,771 | A | 2/1986 | Worwa | 15/319 |
| 4,580,313 | A | 4/1986 | Blehert | 15/349 |
| 4,586,208 | A | 5/1986 | Trevarthen | 8/158 |
| 4,595,420 | A | 6/1986 | Williams, III et al. | 134/6 |
| 4,608,086 | A | 8/1986 | Dodge | 106/12 |
| 4,615,070 | A | 10/1986 | Frederick et al. | 15/339 |
| 4,624,026 | A | 11/1986 | Olson et al. | 15/340 |
| 4,634,403 | A | 1/1987 | Peabody et al. | 474/1 |
| 4,667,364 | A | 5/1987 | Meili | 15/320 |
| 4,675,935 | A | 6/1987 | Kasper et al. | 15/319 |
| 4,676,287 | A | 6/1987 | Fitzwater | 141/285 |
| 4,676,926 | A | 6/1987 | Kappler | 252/307 |
| 4,679,271 | A | 7/1987 | Field et al. | 15/49 |
| 4,709,771 | A | 12/1987 | Basham et al. | 180/6.5 |
| 4,729,141 | A | 3/1988 | Berg et al. | 15/49 |
| 4,757,566 | A | 7/1988 | Field et al. | 15/49 |
| 4,766,432 | A | 8/1988 | Field | 340/825.17 |
| 4,768,311 | A | 9/1988 | Olson | 51/174 |
| 4,780,243 | A | 10/1988 | Edgley et al. | 252/307 |
| 4,805,256 | A | 2/1989 | Mason et al. | 15/320 |
| 4,805,258 | A | 2/1989 | Sitarski et al. | 15/385 |
| 4,817,233 | A | 4/1989 | Waldhauser | 15/320 |
| 4,819,676 | A | 4/1989 | Blehert et al. | 134/21 |
| 4,822,431 | A | 4/1989 | Bricher et al. | 134/28 |
| 4,838,457 | A | 6/1989 | Swahl et al. | 222/48 |
| 4,849,027 | A | 7/1989 | Simmons | 134/22.18 |
| 4,866,804 | A | 9/1989 | Masbruch et al. | 15/49 |
| 4,881,288 | A | 11/1989 | May et al. | 15/98 |
| 4,903,718 | A | 2/1990 | Sullivan | 134/184 |
| 4,913,316 | A | 4/1990 | Richter | 221/1 |
| 4,967,064 | A | 10/1990 | Field et al. | 250/203.2 |
| 4,974,618 | A | 12/1990 | Nysted | 134/21 |
| 4,986,378 | A | 1/1991 | Kasper | 180/6.48 |
| 4,996,468 | A | 2/1991 | Field et al. | 318/587 |
| 5,013,333 | A | 5/1991 | Beaufoy et al. | 55/21 |
| 5,016,310 | A | 5/1991 | Geyer et al. | 15/49.1 |
| 5,031,837 | A | 7/1991 | Hanish | 239/267 |
| 5,044,043 | A | 9/1991 | Basham et al. | 15/319 |
| 5,045,118 | A | 9/1991 | Mason et al. | 134/21 |
| 5,060,342 | A | 10/1991 | Brazier | 15/322 |
| 5,064,010 | A | 11/1991 | Masbruch et al. | 180/6.5 |
| 5,088,149 | A | 2/1992 | Berg et al. | 15/322 |
| 5,093,955 | A | 3/1992 | Blehert et al. | 15/320 |
| RE33,926 | E | 5/1992 | Waldhauser | 15/320 |
| 5,133,107 | A | 7/1992 | MacDonald | 15/50.3 |
| 5,207,642 | A | 5/1993 | Orkin et al. | 604/65 |
| 5,212,848 | A | 5/1993 | Geyer | 15/401 |
| 5,213,120 | A | 5/1993 | Dickson | 134/102.1 |
| 5,231,725 | A | 8/1993 | Hennessey et al. | 15/83 |
| 5,244,003 | A | 9/1993 | Boomgaarden | 137/1 |
| 5,254,146 | A | 10/1993 | Beaufoy | 55/320 |
| 5,276,933 | A | 1/1994 | Hennessey et al. | 15/83 |
| 5,295,277 | A | 3/1994 | Koenigs et al. | 15/83 |
| 5,303,448 | A | 4/1994 | Hennessey et al. | 15/340.3 |
| 5,319,828 | A | 6/1994 | Waldhauser et al. | 15/320 |
| 5,383,605 | A | 1/1995 | Teague | 239/526 |
| RE35,033 | E | 9/1995 | Waldhauser | 15/320 |
| 5,455,985 | A | 10/1995 | Hamline et al. | 15/401 |
| 5,462,607 | A | 10/1995 | Mestetsky et al. | 134/22.12 |
| 5,483,718 | A | 1/1996 | Blehert et al. | 15/50.3 |
| 5,509,972 | A | 4/1996 | Akazawa et al. | 134/26 |
| 5,515,568 | A | 5/1996 | Larson et al. | 15/50.3 |
| 5,526,547 | A | 6/1996 | Williams et al. | 15/320 |
| 5,566,422 | A | 10/1996 | Geyer | 15/320 |
| 5,593,091 | A | 1/1997 | Harris | 239/127 |
| 5,647,093 | A | 7/1997 | Engel et al. | 15/352 |
| 5,649,643 | A | 7/1997 | Ridgeway | 222/105 |
| 5,659,921 | A | 8/1997 | Narayan | 15/349 |
| 5,711,775 | A | 1/1998 | Field et al. | 55/273 |
| 5,735,017 | A | 4/1998 | Barnes et al. | 15/321 |
| 5,738,248 | A | 4/1998 | Green | 222/129.2 |
| 5,813,086 | A | 9/1998 | Ueno et al. | 15/320 |
| 5,816,298 | A | 10/1998 | Stricklin et al. | 141/346 |
| 5,819,008 | A * | 10/1998 | Asama et al. | 700/255 |
| 5,829,094 | A | 11/1998 | Field et al. | 15/352 |
| 5,836,045 | A | 11/1998 | Anthony et al. | 15/320 |
| 5,853,814 | A | 12/1998 | Murphy | 427/434.6 |
| 5,871,152 | A | 2/1999 | Saney | 239/8 |
| 5,884,353 | A | 3/1999 | Berg et al. | 15/83 |
| 5,893,189 | A | 4/1999 | D'Costa | 15/83 |
| 5,901,407 | A | 5/1999 | Boomgaarden | 15/320 |
| 5,940,928 | A | 8/1999 | Erko | 15/319 |
| 5,940,929 | A | 8/1999 | Berg | 15/334 |

| | | | | |
|---|---|---|---|---|
| 5,943,724 | A | 8/1999 | Erko et al. | 15/49.1 |
| 5,943,730 | A | 8/1999 | Boomgaarden | 15/320 |
| 5,967,747 | A | 10/1999 | Burke et al. | 415/206 |
| 5,983,447 | A | 11/1999 | Boomgaarden | 15/354 |
| 5,991,953 | A | 11/1999 | Durenberger et al. | 15/83 |
| 5,995,884 | A * | 11/1999 | Allen et al. | 701/24 |
| 5,996,173 | A | 12/1999 | Engel et al. | 15/352 |
| 5,996,174 | A | 12/1999 | Boomgaarden et al. | 15/354 |
| 6,003,186 | A | 12/1999 | Larson | 15/82 |
| 6,018,844 | A | 2/2000 | Basham et al. | 15/349 |
| 6,035,479 | A | 3/2000 | Basham et al. | 15/83 |
| 6,073,295 | A | 6/2000 | Durenberger et al. | 15/83 |
| 6,090,217 | A | 7/2000 | Kittle | 134/11 |
| 6,092,261 | A | 7/2000 | Boomgaarden | 15/323 |
| 6,117,200 | A | 9/2000 | Berg et al. | 55/287 |
| 6,125,495 | A | 10/2000 | Berg et al. | 15/183 |
| 6,131,766 | A | 10/2000 | King et al. | 222/1 |
| 6,192,542 | B1 | 2/2001 | Frederick et al. | 15/84 |
| 6,202,243 | B1 | 3/2001 | Beaufoy et al. | 15/49.1 |
| 6,209,756 | B1 | 4/2001 | Van Der Heijden | 222/105 |
| 6,220,865 | B1 * | 4/2001 | Macri et al. | 434/247 |
| 6,249,926 | B1 | 6/2001 | Wulff | 15/50.1 |
| 6,276,613 | B1 | 8/2001 | Kramer | 239/304 |
| 6,283,221 | B2 | 9/2001 | Hurray et al. | 169/30 |
| 6,286,169 | B1 | 9/2001 | D'Costa et al. | 15/52.1 |
| 6,389,641 | B1 | 5/2002 | Boomgaarden et al. | 15/340.1 |
| 6,398,829 | B1 | 6/2002 | Shinler et al. | 55/317 |
| 6,401,294 | B2 | 6/2002 | Kasper | 15/320 |
| 6,418,586 | B2 | 7/2002 | Fulghum | 15/320 |
| 6,421,870 | B1 | 7/2002 | Basham et al. | 15/83 |
| 6,425,958 | B1 | 7/2002 | Giddings et al. | 134/21 |
| 6,428,590 | B1 | 8/2002 | Lehman et al. | 55/334 |
| 6,449,793 | B2 | 9/2002 | D'Costa et al. | 15/52.1 |
| 6,493,612 | B1 * | 12/2002 | Bisset et al. | 701/23 |
| 6,505,379 | B2 | 1/2003 | Keller | 15/339 |
| 6,507,968 | B1 | 1/2003 | Hansen | 15/49.1 |
| 6,523,992 | B1 | 2/2003 | Bublewitz et al. | 366/172.1 |
| 6,530,102 | B1 | 3/2003 | Pierce et al. | 15/52.1 |
| 6,543,580 | B1 | 4/2003 | Gathmann et al. | 184/7.4 |
| 6,560,817 | B2 * | 5/2003 | Deiterman et al. | 15/320 |
| 6,585,827 | B2 | 7/2003 | Field et al. | 134/6 |
| 6,602,018 | B2 | 8/2003 | Feeny et al. | 403/227 |
| 6,614,195 | B2 | 9/2003 | Bushey et al. | 318/135 |
| 6,618,888 | B2 | 9/2003 | Joynt et al. | 15/49.1 |
| 6,651,286 | B2 | 11/2003 | Pierce | 15/98 |
| 6,658,325 | B2 * | 12/2003 | Zweig | 700/245 |
| 6,662,402 | B2 | 12/2003 | Giddings et al. | 15/320 |
| 6,662,600 | B1 | 12/2003 | Field et al. | 68/17 |
| D485,175 | S | 1/2004 | Field et al. | D9/432 |
| 6,671,925 | B2 | 1/2004 | Field et al. | 15/320 |
| 6,705,332 | B2 | 3/2004 | Field et al. | 134/102.1 |
| 6,735,811 | B2 | 5/2004 | Field et al. | 15/320 |
| 6,735,812 | B2 | 5/2004 | Hekman et al. | 15/320 |
| 6,742,219 | B2 | 6/2004 | Lenzmeier et al. | 15/345 |
| 6,802,098 | B2 | 10/2004 | Geyer et al. | 15/52.1 |
| 6,836,919 | B2 | 1/2005 | Shinler | 15/78 |
| 6,877,180 | B2 | 4/2005 | Wilmo et al. | 15/83 |
| 6,895,363 | B2 | 5/2005 | Erko et al. | 702/183 |
| 6,968,592 | B2 * | 11/2005 | Takeuchi et al. | 15/319 |
| 2001/0022010 | A1 | 9/2001 | Kasper | 15/320 |
| 2003/0019071 | A1 | 1/2003 | Field et al. | 15/320 |
| 2003/0029885 | A1 | 2/2003 | Kawolics et al. | 222/105 |
| 2004/0040102 | A1 | 3/2004 | Field et al. | 15/50.1 |
| 2004/0187895 | A1 | 9/2004 | Field et al. | 134/26 |
| 2004/0221407 | A1 | 11/2004 | Field et al. | 15/50.1 |
| 2005/0022844 | A1 | 2/2005 | Field et al. | 422/24 |
| 2005/0217062 | A1 | 10/2005 | Field et al. | 15/320 |

FOREIGN PATENT DOCUMENTS

| | | |
|---|---|---|
| EP | 0 744 148 A2 | 11/1996 |
| EP | 1 044 645 A2 | 10/2000 |
| WO | WO 00/35333 | 6/2000 |
| WO | WO 02/05047 | 1/2002 |
| WO | WO 02/06435 | 1/2002 |
| WO | WO 03/011097 | 2/2003 |
| WO | WO 03/011098 | 2/2003 |
| WO | WO 03/011099 | 2/2003 |

OTHER PUBLICATIONS

U.S. Appl. No. 11/211,987, filed Aug. 25, 205.

International Search Report and Written Opinion for International Application No. PCT/US05/40565. Date of Mailing: Jan. 9, 2006.

* cited by examiner

MOBILE FLOOR CLEANER DATA COMMUNICATION

CROSS-REFERENCE TO RELATED APPLICATION

The present application is based on and claims the benefit of U.S. provisional patent application Ser. No. 60/627,751, filed Nov. 12, 2004, the content of which is hereby incorporated by reference in its entirety.

BACKGROUND

Mobile floor cleaners include motorized cleaning tools that are used to perform a cleaning operation on a floor surface. These cleaners include floor surface cleaners that are used to scrub and/or sweep hard floor and carpeted surfaces.

Information relating to the use of the cleaner, the status of components of the cleaner, and other information can be used in many different ways. For example, usage information can be used to anticipate when the cleaner may require service including the performance of a repair or the replacement of a consumable component.

There is a continuous demand for improvements to mobile floor cleaners including the collection and communication of such information relating to the cleaner.

The discussion above is merely provided for general background information and is not intended to be used as an aid in determining the scope of the claimed subject matter.

SUMMARY

One embodiment of the invention relates to a method of communicating data from a mobile floor cleaner to a remote receiver. The mobile floor cleaner includes a mobile body, a motorized cleaning tool supported by the mobile body, a controller and a communicator. In the method, a data communication is initiated from the communicator to the remote receiver and data is communicated to the remote receiver with the communicator.

Another embodiment of the invention relates to a mobile floor cleaner. The mobile floor cleaner includes a mobile body, a motorized cleaning tool supported by the mobile body, a controller and a communicator. The controller is configured to initiate a data communication from the communicator to the remote receiver and to communicate data to the remote receiver.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Figure 1:
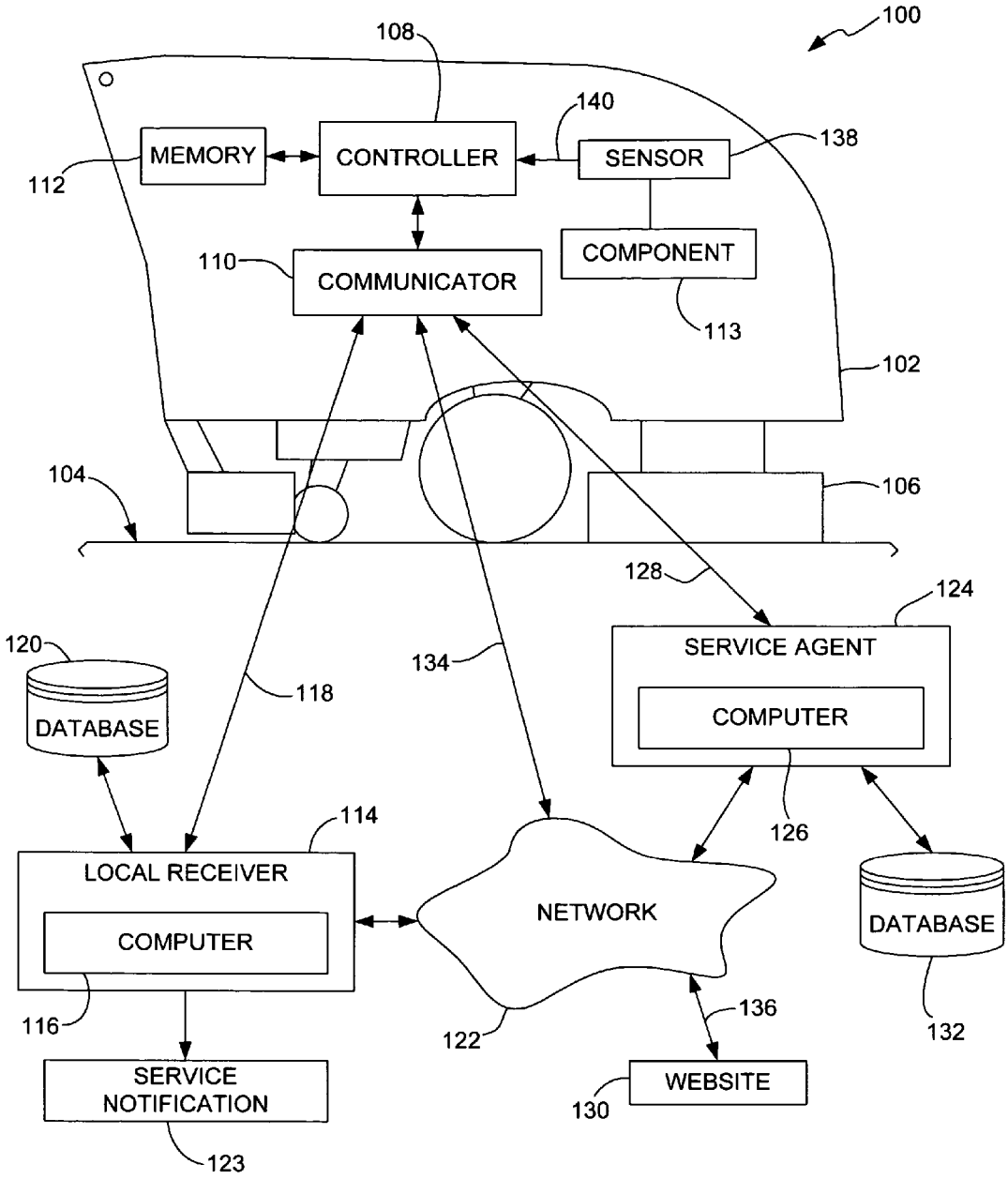
FIG. 1 is a block diagram illustrating an exemplary mobile floor cleaner and several exemplary communication paths in accordance with embodiments of the invention.

Embodiments of the present invention generally relate to mobile floor cleaner data communications. FIG. 1 is a block diagram illustrating an exemplary mobile floor cleaner and several exemplary communication paths in accordance with various embodiments of the invention. Embodiments of the mobile floor cleaner 100 include a mobile body 102 that is motorized for travel across the floor surface 104 in accordance with conventional methods. The mobile floor cleaner 100 can be powered by batteries, a combustible engine, line power, and/or by another suitable power source.

In one embodiment, the mobile floor cleaner includes a motorized cleaning tool 106 that is supported by the mobile body and is used to perform cleaning or conditioning operations on the surface. Exemplary motorized cleaning tools include a scrub brush (e.g., disc scrub brush or pad, or a cylindrical scrub brush), a sweeper brush (e.g., disc or cylindrical), a combination sweep and scrub brush, a burnishing pad, a polishing pad, or other motorized cleaning tool used to perform hard floor and/or carpeted surface cleaning or conditioning operations. Although, the exemplary mobile floor cleaner 100 is illustrated as a walk-behind cleaner, embodiments of the present invention also apply to ride-on floor cleaners.

The mobile floor cleaner 100 also includes a controller (e.g., microcontroller, microcomputer, etc.) 108 and a communicator 110. The controller 108 operates to control communications (i.e., data receptions and transmissions) from the cleaner 100 using the communicator 110. The actual components that form the controller 108 and the communicator 110 can include several shared and/or separated components. The controller 108 can also perform other tasks, as will be discussed below in greater detail.

Figure 2:
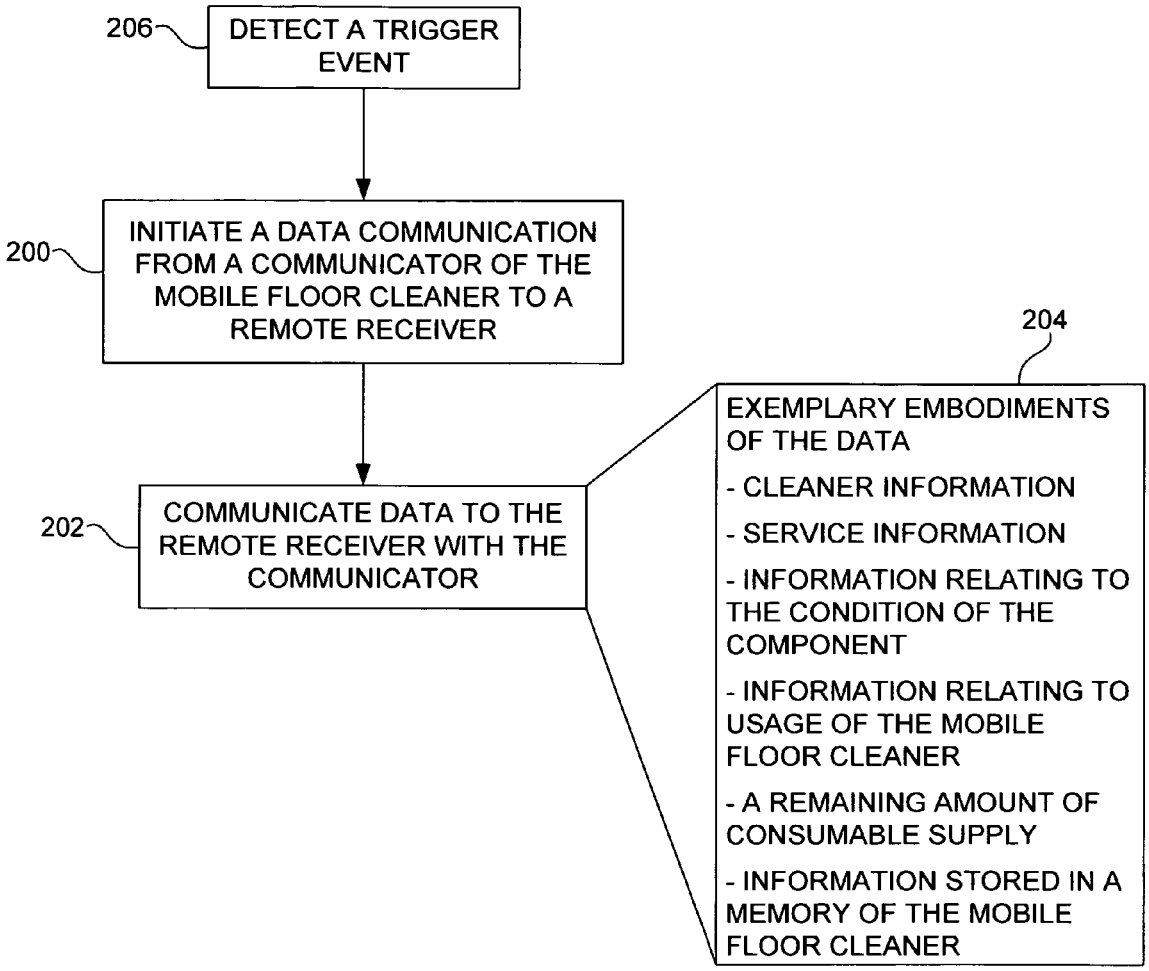
FIG. 2 is a flowchart illustrating a method of communicating data from a mobile floor cleaner to a remote receiver in accordance with embodiments of the invention.

FIG. 2 is a flowchart illustrating a method of communicating data from a mobile floor cleaner 100 in accordance with embodiments of the invention. At step 200 of the method, a data communication is initiated from the communicator 110 of the mobile floor cleaner 100 to a remote receiver and, at step 202, data is communicated to the remote receiver with the communicator 110. It should be understood that the initiation of the data communication in step 200 by the mobile floor cleaner 100 means that the data communication 202 is not initiated or begun as a result of a request (e.g., a poll or ping for data) from an agent (i.e. the remote receiver) that is outside of the mobile floor cleaner 100. Thus, the controller 108 of the mobile floor cleaner 100 operates independently of such a request to initiate the data communication using the communicator. For example, the controller 108 of the mobile floor cleaner 100 can perform the initiation step 200 by polling or pinging the remote receiver to notify the receiver of a data communication, or transmit the data for reception by the remote receiver without the notification of the data transmission.

The data communication of step 202 can include many different types of information. In one embodiment, the data communication includes cleaner information relating to the mobile floor cleaner 100, as indicated in the expansion box 204 of FIG. 2. Exemplary cleaner information includes an identification of the mobile floor cleaner (e.g., a serial number), an identification of the owner of the mobile floor cleaner, a location of the mobile floor cleaner, an identification of components of the mobile floor cleaner and other information relating to the mobile floor cleaner. This information can be stored in a memory 112 of the cleaner 100 that is accessible by the controller 108.

In one embodiment the cleaner information includes usage information. Such usage information can include the time that the cleaner has been operated, the time the cleaner has been operated since the last data communication 202, the time that a component (e.g., a scrub brush or pad, a consumable supply, etc.) has been used by the cleaner, and other cleaner usage measurements.

In another embodiment, the data communication of step 202 includes service information relating to servicing of the mobile floor cleaner, as indicated in box 204. Exemplary service information includes, an identification or request for service of the mobile floor cleaner, an identification of a particular problem with the mobile floor cleaner, an identification of a malfunctioning component 114 of the mobile floor cleaner, an order for service for the mobile floor cleaner, an order for a new component 114 for the mobile floor cleaner, an order for a new consumable supply for the mobile floor cleaner, a identification of a servicing agent, and other information relating to servicing of the mobile floor cleaner 100. This service information can be stored in the memory 112 of the cleaner 100.

In other embodiments, the communicator 110 is configured to both transmit and receive data. The transmissions and receptions of data are generally controlled by the controller 108 and can be performed in accordance with conventional communication techniques, such as those described below.

The remote receiver generally refers to any recipient of the data communication that is outside of the mobile floor cleaner 100 and can take on many different forms. In general, the remote receiver is configured to receive the data communication from the communicator 110 in step 202. In accordance with other embodiments, the communicator 110 is configured to receive data communications from the remote receiver.

In one embodiment, the remote receiver includes a local receiver 114 that includes a computer 116, a personal digital assistant, a wireless router, or other device with which the communicator 110 is configured to transmit data to or through, as indicated by arrow 118. In one embodiment, the local receiver 114 can access a database 120 to store information received from the cleaner 100, such as that described above, and other information.

In another embodiment, the local receiver is configured to communicate over a network 122, such as the internet or other communication medium, to another remote receiver. Thus, the local receiver 114 can be an intermediary recipient of the data communication that transmits either raw or processed data to another remote receiver, such as those discussed below.

In one embodiment, the local receiver provides a service notification 123 to the administrator or operator of the cleaner 100 in response to the data communication of step 202 that indicates that the cleaner 100 requires service of some kind. The service notification can take on many different forms including an email message, a text message, an alert on a display of the computer or mobile floor cleaner, an audible alarm, a visible alarm, or other type of notification that the cleaner requires service.

Another embodiment of the remote receiver includes a service agent 124 that is responsible for servicing the cleaner 100 or for administrating the servicing of the cleaner 100. For example, the service agent 124 can respond to orders for additional consumable components (e.g., cleaning agent supplies, scrub brushes, scrub pads, etc.), non-consumable components, and servicing of the cleaner 100.

In one embodiment, the service agent includes a computer 126 or other suitable device for handling the data communication (step 202) from the communicator 110, as indicated by arrow 128, or from an intermediary recipient, such as the local receiver 114 or a website 130 through the network 122 or other communication medium.

In one embodiment, the service agent 124 has access to a database 132 for storing and retrieving information relating to the cleaner 100. This information can include the cleaner information and service information communicated during step 202 described above, as well as historical records for the cleaner 100 and the owner of the cleaner.

Another embodiment of the remote receiver includes the website 130. The communicator 110 communicates the data during step 202 either through a direct connection to the network 122, as indicated by arrows 134 and 136, or indirectly through the local receiver 114 or the service agent 124. The information communicated during step 202 of the method can be stored at the website for later retrieval by the service agent 124, the local receiver 114, or other entity.

The data communication 202 can be performed through a direct or physical connection or wirelessly. Exemplary direct connections include cable connections, docking stations, etc.

Exemplary wireless communicators 110 include a radio frequency (RF) communications device to perform wireless data transmissions and, in one embodiment, data receptions. The RF communications device can include an RF transmitter and an RF receiver. In one embodiment, the communicator 110 includes a low power (1 milliwatt) serial RF communications device configured for communicating 19.2 kilobits per second (kbps) at a frequency of 915.5 megahertz (MHz). This technology is mostly suitable for data communications over short distances, such as to the local remote receiver 114. However, the data communication can be extended over a greater distance through a suitable relay device.

In accordance with another embodiment of the invention, the communicator 110 includes a cellular communications device that is configured to communicate with one or more of the remote receivers. The cellular communications device can operate with conventional cellular communication networks, such as Code Division Multiple Access (CDMA), General Packet Radio Service device (GPRS), Time Division Multiple Access (TDMA), Global System for Mobile (GSM), and other mobile communication networks.

Another exemplary wireless embodiment of the communicator 110 includes an infrared device that transmits the data using an infrared signal that is received by a remote infrared receiver at the local receiver.

In one embodiment, the initiation of the data communication in step 200 is performed in response to a trigger event, as indicated at step 206. In other words, the controller 108 initiates the communication in response to the trigger event, such as a notification of the occurrence of an event.

The trigger event can take on many different forms. Exemplary embodiments of trigger events include time-related events. Exemplary time-related trigger events include performing the step 200 at a predefined time, such as during non-operating times. Other time-related trigger events include performing the step 200 after a predefined amount of time has elapsed from a reference, such as after a predefined amount of use of the mobile floor cleaner 100, or a predefined amount of time since the last data communication or attempted data communication by the mobile floor cleaner 100, or at predefined intervals of time. The time-related trigger event settings can be stored in the memory 112 of the cleaner and adjustable by the operator of the cleaner.

In another embodiment, the trigger event includes the moving of the mobile floor cleaner 100 to a predefined location (e.g., a staging area for the cleaner), the setting of which can be stored in the memory 112. In one embodiment, the mobile floor cleaner 100 includes a local positioning device or a global positioning device (e.g., global positioning satellite device). When the mobile floor cleaner 100 moves to the predefined location, as detected by the positioning device, the controller of the mobile floor cleaner performs the initiating step 200 using the communicator 110.

In accordance with one embodiment, the mobile floor cleaner 100 includes a sensor 138. The sensor 138 produces an output signal 140 that is indicative of a parameter or variable of the mobile floor cleaner 100. In one embodiment, the detection of the trigger event in step 206 is based on the output signal 140 from the sensor 138.

In one embodiment, the sensor 138 is configured to sense a condition of the component 113 and the output signal 140 from the sensor 138 is indicative of the condition of the component 113. Exemplary embodiments of the component 113 include consumable and non-consumable forms. Exemplary non-consumable components 113 include, electric motors, power converters, pumps, combustion engine components, and other components of the cleaner that may degrade over time, but generally are not reduced or depleted. Exemplary consumable components 113 include consumable supplies, such as cleaning liquid component supplies (e.g., cleaning agents or additives), consumable power supplies (e.g., batteries, fuel supplies, etc.) of the mobile floor cleaner. Scrub brushes, scrub pads and sweeper brushes can also be considered consumable components 113 because they wear out and must be replaced on a regular basis.

For non-consumable components 113, one embodiment of the condition sensed by the sensor 138 and indicated by the output signal 140 includes a health or status of the component 113. Accordingly, the output signal 140 from the sensor 130 can include diagnostic information used to identify a problem in the component 113 or a present state of the component 113. For instance, with regard to electrical components 113, the output signal 140 of the sensor 138 could be indicative of a current, a voltage, resistance, temperature, or other parameter that is indicative of the health or state of the component 113.

In one embodiment, the controller 108 monitors the output signal 140 to detect a potential problem with the component 113 or a present state of the component 113. For example, a problem with the component 113 or a certain state can be indicated when the output signal 140 of the sensor 138 changes a predefined amount or reaches a predefined relationship to a threshold (e.g., meets, exceeds or drops below the threshold), which can be stored in the memory 112. The data communication step 202 can include information relating to the condition of the component, as indicated by the sensor output 140.

For consumable components 113, one embodiment of the sensor 138 detects a remaining amount of the consumable component 113. Thus, the output signal 140 of the sensor 138 can be indicative of the remaining amount of the consumable. Embodiments of the present invention include any type of sensor 138 that used to detect the remaining amount of a consumable component 113.

In accordance with one embodiment, the controller 108 processes the output signal 140 from the sensor 138 and triggers step 200 of the method to initiate the data communication automatically when the output signal 140 indicates that the remaining amount of the consumable component 113 has dropped below a predefined threshold. In one embodiment of step 202, the data communication includes information relating to the remaining amount of the consumable component 113, as indicated in FIG. 2.

Figure 3:
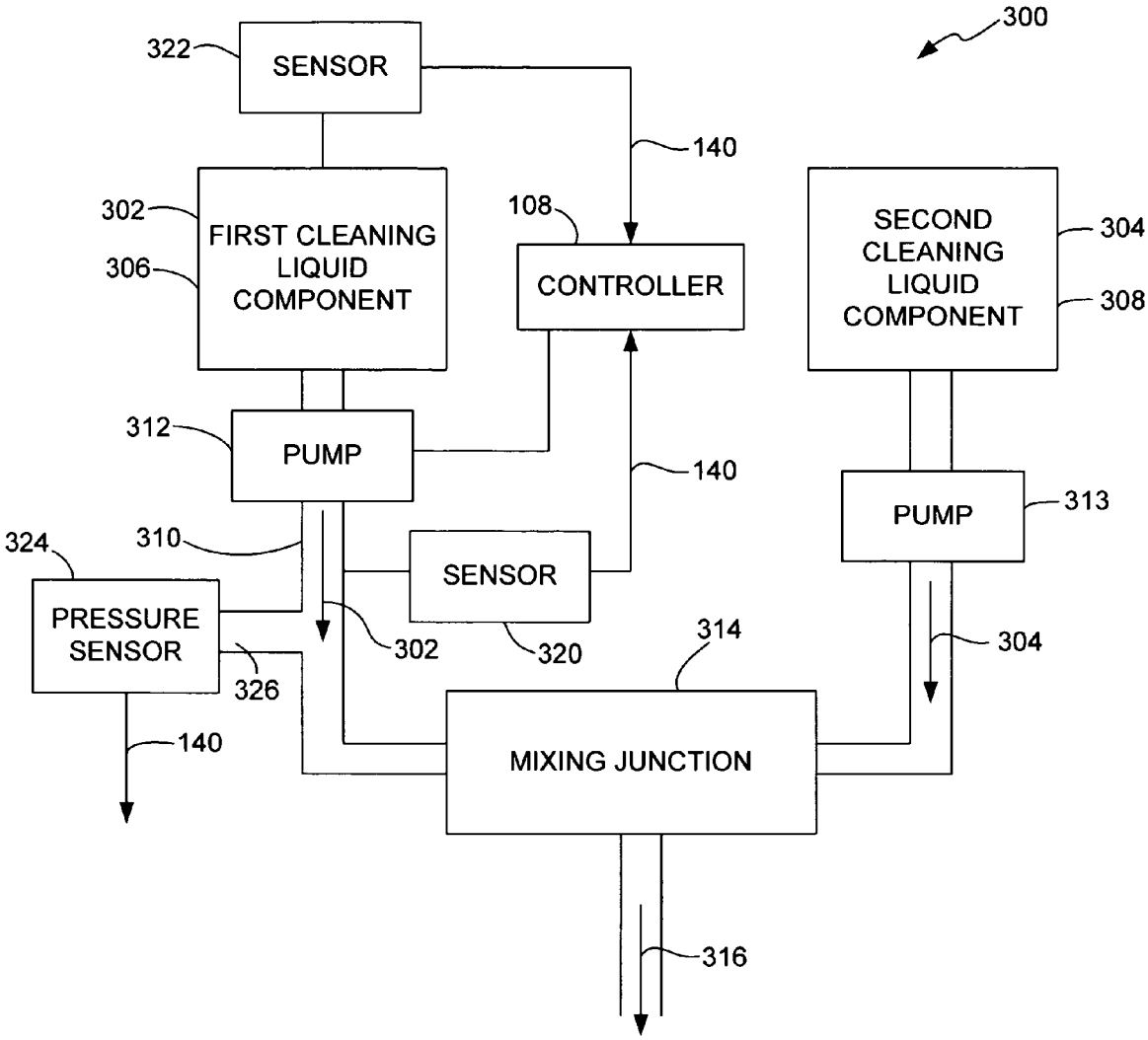
FIG. 3 is a block diagram of a cleaning liquid dispensing system of a mobile floor cleaner in accordance with embodiments of the invention.

In one embodiment, the component 113 includes a consumable supply in the form of a cleaning liquid component (e.g., a cleaning agent or additive) used in a cleaning liquid dispensing system of the mobile floor cleaner 100 to dispense a cleaning liquid used during floor cleaning operations. FIG. 3 is a block diagram depicting a cleaning liquid dispensing system 300 of a mobile floor cleaner 100 in accordance with embodiments of the invention. The cleaning liquid dispensing system 300 includes first and second cleaning liquid components 302 and 304 that are respectively contained in first and second containers 306 and 308. In one embodiment, the first cleaning liquid component 302 includes a cleaning agent that is discharged into a conduit line 310. The second cleaning liquid component 304 is preferably a primary cleaning liquid component, such as water, that can be stored in a tank of the mobile floor cleaner 100.

The cleaning liquid dispensing system 300 also includes a flow control device that includes one or more pumps (e.g., pump 312 and pump 313) and a mixing junction 314. The mixing junction 314 can be a fluid injector, such as a venturi injector, or a t-junction in the conduit.

During a normal floor cleaning operation, the first cleaning liquid component 302 is either pumped out of the first container 306 and into the conduit line 310 with the pump 312, or sucked out due to a vacuum produced by the pumping of the second cleaning liquid component 304 by the pump 313. The first cleaning liquid component 302 is then mixed with the second cleaning liquid component 304 at the mixing junction 314 and discharged as cleaning liquid 316.

The triggering event occurs or is detected when the remaining amount of the first cleaning liquid component 302 reaches a predefined threshold stored in the memory 112 of the cleaner 100 or provided through other suitable means (e.g. a signal). The monitoring of the remaining amount of the first cleaning liquid component 302 can be accomplished in many different ways.

In one embodiment, a starting amount of the consumable 302 is known and is preferably stored in the memory 112 along with a known flow rate at which the consumable 302 is fed to the mixing junction 314. With this information, the controller 108 can monitor when the dispensing system 300 is activated by the activation of the one or more pumps and maintain a remaining amount of the consumable 302 in the memory 112 by subtracting the amount of consumable used during a period of activation (i.e., time of activation multiplied by the volumetric flow rate) from the previous remaining amount. Alternatively, the dispensing system 300 can include a flow sensor 320 that detects a flow of the first cleaning liquid component 302 through the conduit 310, from which the volumetric flow rate of the component 302 can be calculated and used to maintain an account of the amount remaining in the container 306.

In another embodiment, a level sensor 322 is used to detect a level of the consumable 302 that remains in the container 306. A comparison can then be made by the controller 108 between the sensed level of the first cleaning liquid component 302 and a threshold level stored in the memory 112 or provided through other suitable methods.

When the sensed level reaches a predetermined relationship to the threshold, the triggering event occurs or is detected (step 206) by the controller 108.

In yet another embodiment, the cleaner 100 includes a sensor that detects a weight of the remaining amount of the first cleaning liquid component 302. A comparison can then be made between the weight indicated by the sensor and a threshold weight to determine whether the supply of the first cleaning liquid component 302 is low or substantially empty, at which time the triggering event occurs or is detected (step 206).

In one embodiment, the first cleaning liquid component 302 is contained in a sealed and collapsible container 306. Eventually, the use of the first cleaning liquid component 302 causes the collapsible container 306 to empty, at which time the container 306 is substantially collapsed even though it may contain some residual of the first cleaning liquid component 302. The continued application of the vacuum to the conduit line 310, produced by the flow control device, causes a buildup of negative pressure within the conduit line 310. For example, the pressure in the conduit line 310 may operate normally (i.e., when a supply of the first cleaning liquid component 302 is contained in the container 306) at a pressure of approximately 0 psi. However, when the container 306 becomes emptied of the first cleaning liquid component 302 and is substantially collapsed, the pressure may reach −20 psi or less.

In accordance with one embodiment, the floor cleaner 100 includes a pressure sensor 324 that is configured to measure a pressure in the line of conduit 310 through which the first cleaning liquid component 302 travels. Access to the pressure in the conduit 310 is provided by a tap 326 in the conduit 310. The pressure sensor 324 is configured to produce a sensor signal 140 that is indicative of the pressure in the line of conduit 310. One suitable pressure sensor is the MVS-Z pressure sensor having a part number 124276-01 produced by Dwyer.

The controller 108 of the mobile floor cleaner 100 is configured to receive the output signal 140 from the pressure sensor 324, or a value represented by the sensor signal 140, and compare the value to a threshold reference to determine whether the first cleaning liquid component 302 is low or empty, or whether the flow of the first cleaning liquid component 302 in conduit 310 is blocked. Accordingly, when the sensor signal 140 indicates a pressure of a higher vacuum than the threshold reference, it is known that the floor cleaner 100 requires service in the form of a new container of the first cleaning liquid component 302 or the removal of any blockage that may be preventing the flow of the first cleaning liquid component 302 through the conduit 310.

Alternatives to the pressure sensor 324 described above can also be used to provide the desired monitoring of the remaining amount of the first cleaning liquid component 302. For example, a differential pressure sensor could be used across a flow obstruction (e.g., an orifice plate) that is positioned in line with the conduit 310. In the event that the remaining amount of the first cleaning liquid component 302 becomes substantially depleted or the flow of the first cleaning liquid component 302 becomes blocked, the differential pressure sensor would measure zero pressure difference across the flow obstruction during a period when a flow of the first cleaning liquid component 302 is expected (i.e., during normal operation of the floor cleaner 100), rather than a non-zero differential pressure when a flow of the first cleaning liquid component 302 travels through the flow obstruction.

In another embodiment, the sensor 138 (FIG. 1) detects usage of the mobile floor cleaner 100, such as when it is being operated, when a cleaning operation is taking place, a distance of the cleaner travels, and other information relating to the usage of the mobile floor cleaner. In one embodiment, the controller performs the communication initiating step 200 when an amount of usage of the cleaner or a component 113 reaches a predefined relationship to a threshold. As above, the threshold can be stored in memory or provided through other suitable methods. In one embodiment, the data communication 202 includes information relating to the usage of the mobile floor cleaner 100, as indicated in FIG. 2.

For instance, when the consumable component 113 is one that wears over time due to use, the sensor 138, can include a device that indicates usage of the consumable component 113, from which a period of time that the component 113 has been used can be determined or estimated. Thus, when the period of time has reached a predetermined relationship to a threshold value, the controller 108 can automatically trigger step 200 of the method. For instance, a scrub brush or scrub pad of the cleaning tool 106 may require replacement after 30 hours of cleaning operations with the tool. The sensor can be used by the controller 108 to determine when the cleaning operations using the cleaning tool 106 reach 30 hours, or another threshold that is some fraction thereof. When the time of use threshold has been reached, step 206 is completed and step 200 can be performed by the controller 108 to order more of the consumable component 113 or request other service in the data communication step 202, for example.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A mobile floor cleaner comprising:

a mobile body;

a motorized cleaning tool supported by the mobile body;

a sensor configured to produce an output signal based on usage of the mobile floor cleaner;

a communicator; and a controller configured to initiate a data communication from the communicator to the remote receiver and to communicate data to the remote receiver, wherein the data includes usage information including a period of time that the mobile floor cleaner has been operated, which is based on the output signal.

2. The mobile floor cleaner of claim 1, wherein the communicator is a radio frequency communicator.

3. A method of communicating data from a mobile floor cleaner to a remote receiver, the mobile floor cleaner including a mobile body, a motorized cleaning tool supported by the mobile body, a controller and a communicator, the method comprising steps of:

initiating a data communication from the communicator to the remote receiver; and communicating data to the remote receiver with the communicator, wherein the data includes usage information including a period of time that the mobile floor cleaner has been operated.

4. The method of claim 3, wherein the period of time corresponds to the amount of time that the motorized cleaning tool has been operated.

5. The method of claim 3, wherein the period of time corresponds to the amount of time that the mobile floor cleaner has been operated since a preceding data communication with the remote receiver.

6. The method of claim 3, further comprising a step of sensing usage of the mobile floor cleaner, wherein the period of time is based on the sensing step.

7. The method of claim 6, further comprising a step of triggering the initiating step at predetermined intervals.

8. The method of claim 6, wherein the sensing step comprises sensing when the mobile floor cleaner is being operated.

9. The method of claim 8, wherein the sensing step comprises sensing when a cleaning operation is taking place.

10. The method of claim 3, further comprising steps of:

sensing usage of a consumable component of the mobile floor cleaner;

estimating a period of usage of the consumable component based on the sensing step; and triggering the initiating step when the period of usage reaches a predetermined relationship to a threshold value.

11. The method of claim 3, wherein the communicating step further comprises communicating the data using a radio frequency transmitter.

12. The method of claim 3, further comprising sensing a remaining amount of a cleaning liquid component supported on the mobile body, wherein the data includes a measure of the remaining amount of the consumable supply.

13. The method of claim 3, wherein the data includes an identification of the mobile floor cleaner.

14. A method of communicating data from a mobile floor cleaner to a remote receiver, the mobile floor cleaner including a mobile body, a motorized cleaning tool supported by the mobile body, a controller and a communicator, the method comprising steps of:

sensing usage of the mobile floor cleaner;

initiating a radio frequency data communication from the communicator to the remote receiver; and communicating data to the remote receiver with the communicator, wherein the data includes an identification of the mobile floor cleaner and usage information including a period of time that the mobile floor cleaner has been operated, which is based on the sensing step.

15. The method of claim 14, further comprising a step of triggering the initiating step at predetermined intervals.

16. The method of claim 15, wherein the predetermined intervals are based on the sensing step.

17. The method of claim 14, wherein the sensing step comprises sensing when the mobile floor cleaner is being operated.

18. The method of claim 14, wherein the sensing step comprises sensing when a cleaning operation is taking place.

19. The method of claim 14, wherein:

the sensing step includes sensing usage of a consumable component of the mobile floor cleaner; and the method further comprises:

estimating a period of usage of the consumable component based on the sensing step; and triggering the initiating step when the period of usage reaches a predetermined relationship to a threshold value.

20. The method of claim 14, further comprising sensing a remaining amount of a cleaning liquid component supported on the mobile body, wherein the data includes a measure of the remaining amount of the consumable supply.

* * * * *